US005273873A

United States Patent [19]

Cole

[11] Patent Number: 5,273,873

[45] Date of Patent: Dec. 28, 1993

[54] CONTROL OF SURFACE IODIDE USING POST PRECIPITATION KC1 TREATMENT

[75] Inventor: David L. Cole, Rochester, N.Y.

[73] Assignee: Eastman Kodak Company, Rochester, N.Y.

[21] Appl. No.: 622,995

[22] Filed: Dec. 6, 1990

[51] Int. Cl.[5] ..... G03C 1/005

[52] U.S. Cl. ..... 430/569; 430/567

[58] Field of Search ..... 430/569, 567

[56] References Cited

U.S. PATENT DOCUMENTS

| | | | |
|---|---|---|---|
| 2,614,929 | 10/1952 | Yutzy et al. . | |
| 3,505,068 | 4/1970 | Beckett et al. . | |
| 3,597,209 | 8/1971 | Chapman | 430/569 |
| 4,210,450 | 7/1980 | Corben . | |
| 4,241,173 | 12/1980 | Saleck et al. . | |
| 4,463,087 | 7/1984 | Maskasky . | |
| 4,496,652 | 1/1985 | Haugh et al. | 430/569 |
| 4,743,532 | 5/1988 | Shibata et al. . | |
| 4,786,588 | 11/1988 | Ogawa . | |
| 4,818,669 | 4/1989 | Ikede et al. . | |
| 4,973,548 | 11/1990 | Chang | 430/567 |
| 4,997,751 | 3/1991 | Kim . | |
| 5,051,344 | 9/1991 | Kuno . | |

FOREIGN PATENT DOCUMENTS

| | | |
|---|---|---|
| 0285308 | 10/1988 | European Pat. Off. . |
| 0408213A2 | 1/1991 | European Pat. Off. . |
| 0408214A2 | 2/1991 | European Pat. Off. . |
| 1162689 | 8/1964 | Fed. Rep. of Germany . |
| 3839470A1 | 6/1989 | Fed. Rep. of Germany . |

OTHER PUBLICATIONS

R. Matejec, H. Frieser, Die Grundlagen der photographischen Prozesse mit Silberhalogeniden, Bd. 1, 1968, Chapter 1.3.2.4., pp. 440–442.

Research Disclosure, vol. 308, No. 119, Photographic Silver Halide Emulsions, Preparations, Addenda, Processing and Systems, Dec. 1989, pp. 993–995.

The Journal of Photographic Science by L. M. Niedzwiecki et al. vol. 35, No. 5, Sep./Oct., 1987, pp. 155–157.

*Primary Examiner*—Charles L. Bowers, Jr.
*Assistant Examiner*—Thorl Chea
*Attorney, Agent, or Firm*—Paul A. Leipold

[57] ABSTRACT

The invention is generally accomplished by at the end of precipitation of a bromoiodide silver halide emulsion, adding a soluble chloride salt to the precipitation prior to emulsion washing. The chloride salt may be added in an amount between 0.05 and about 5 moles per liter of the precipitation. Further, it is preferred that after adding the chloride, the precipitation be held for at least about 10 minutes after the chloride salt addition prior to the washing to remove salts. Further, it is preferred that the salt removal, holding after chloride addition, and precipitation be carried out at about the same temperature.

10 Claims, 6 Drawing Sheets

I/Br COUNT RATIO
1
0.9
0.8
0.7
0.6
0.5
0.4
0.3
0.2
0.1
0
0
100
200
300
400
500
DEPTH (Aangstroms)

I/Br COUNT RATIO
1
0.9
0.8
0.7
0.6
0.5
0.4
0.3
0.2
0.1
0
0
100
200
300
400
500
DEPTH (Aangstroms)

3.0
2.8
2.6
2.4
2.2
2.0
1.8
1.6
1.4
1.2
1.0
.8
.6
.4
.2
0
DENSITY
1B
1A
EXPOSURE 1
0.9
0.8
0.7
0.6
0.5
0.4
0.3
0.2
0.1
0
I/BR COUNT RATIO
0
100
200
300
400
DEPTH (Aangstroms)

I/BR COUNT RATIO
1
0.9
0.8
0.7
0.6
0.5
0.4
0.3
0.2
0.1
0
0
100
200
300
400
DEPTH (Aangstroms)

DENSITY
3
2.8
2.6
2.4
2.2
2
1.8
1.6
1.4
1.2
1
0.8
0.6
0.4
0.2
0
2A
2B
EXPOSURE

DENSITY
3
2.8
2.6
2.4
2.2
2
1.8
1.6
1.4
1.2
1
0.8
0.6
0.4
0.2
0
2A
2B
EXPOSURE

DENSITY
3
2.8
2.6
2.4
2.2
2
1.8
1.6
1.4
1.2
1
0.8
0.6
0.4
0.2
0
2A
2B
EXPOSURE

I/BR COUNT RATIO
1
0.9
0.8
0.7
0.6
0.5
0.4
0.3
0.2
0.1
0
0
100
200
300
400
500
DEPTH (Aangstroms)

I/BR COUNT RATIO
1
0.9
0.8
0.7
0.6
0.5
0.4
0.3
0.2
0.1
0
0
100
200
300
400
500
DEPTH (Aangstroms)

CONTROL OF SURFACE IODIDE USING POST PRECIPITATION KC1 TREATMENT

TECHNICAL FIELD

The invention relates to silver halide photographic materials. It particularly relates to treatment of silver halide photographic grains during their formation to obtain better photographic properties using the treated grains.

BACKGROUND ART

High efficiency photographic emulsions are generally recognized to be silver bromoiodide emulsions. The presence of iodide ions in the silver bromide crystal structure of the grains is recognized to produce latice irregularities that enhance latent image formation (observed as increased imaging sensitivity) on exposure to electromagnetic radiation. Silver halide photography is benefited from the development of tabular grain silver bromoiodide emulsions. As employed herein, the term "tabular grain emulsion" designates any emulsion in which at least 50% of the total grain projected area is accounted for by tabular grains. Whereas tabular grains have long been recognized to exist to some degree in conventional emulsions only recently has the photographically advantageous role of the tabular grain shape been appreciated. The silver bromoiodide tabular grain emulsions exhibiting particularly advantageous photographic properties include the high aspect ratio tabular silver halide emulsions having a ratio of greater than 8:1 and the thin intermediate aspect ratio tabular silver halide emulsions having an average aspect ratio in the range down to 5:1. Typical of preparation of tabular grain emulsions are those techniques described in U.S. Pat. Nos. 4,433,048—Solberg et al and 4,439,520—Kofron et al.

It is known that the halide composition of emulsion grains as precipitated can be modified by halide conversion, i.e., the displacing of more soluble silver halide salt by less soluble salt, such as described by Allentoff et al, U.S. Pat. No. 3,477,852. The halide conversion can be limited to specific position on the silver halide grains, such as described in Maskasky U.S. Pat. No. 4,142,900, European Patent Application EP 273 429, and in European Patent Application EP 273 430. Attention is directed to Section 1 of *Research Disclosure* 308119, December 1989, pages 993-995.

While the bromoiodide emulsions, particularly those with tabular grains, have been successful in producing silver halide grains suitable for photographic use, there remains a need for improved grains. Further, it is desirable that some emulsions previously not utilizable, be improved by treatments after precipitation such that they become more useful.

DISCLOSURE OF THE INVENTION

An object of the invention is to improve the prior photographic silver halide emulsions.

Another object is to provide improved photographic products.

The objects of the invention are generally accomplished by at the end of precipitation of a bromoiodide silver halide emulsion adding a soluble chloride salt to the precipitation prior to washing to remove salts. The chloride salt may be added in an amount between 0.05 and about 5 moles per liter of the precipitation. Further, it is preferred that after adding the chloride, the precipitation be held for at least about 10 minutes after the chloride salt addition prior to washing to remove salts. Further, it is preferred that the salt removal, holding after chloride addition, and precipitation be carried out at about the same temperatures of between about 60° and about 80° C. rather than the normal lower washing temperatures that are commonly utilized.

MODES FOR CARRYING OUT THE INVENTION

Figure 1:
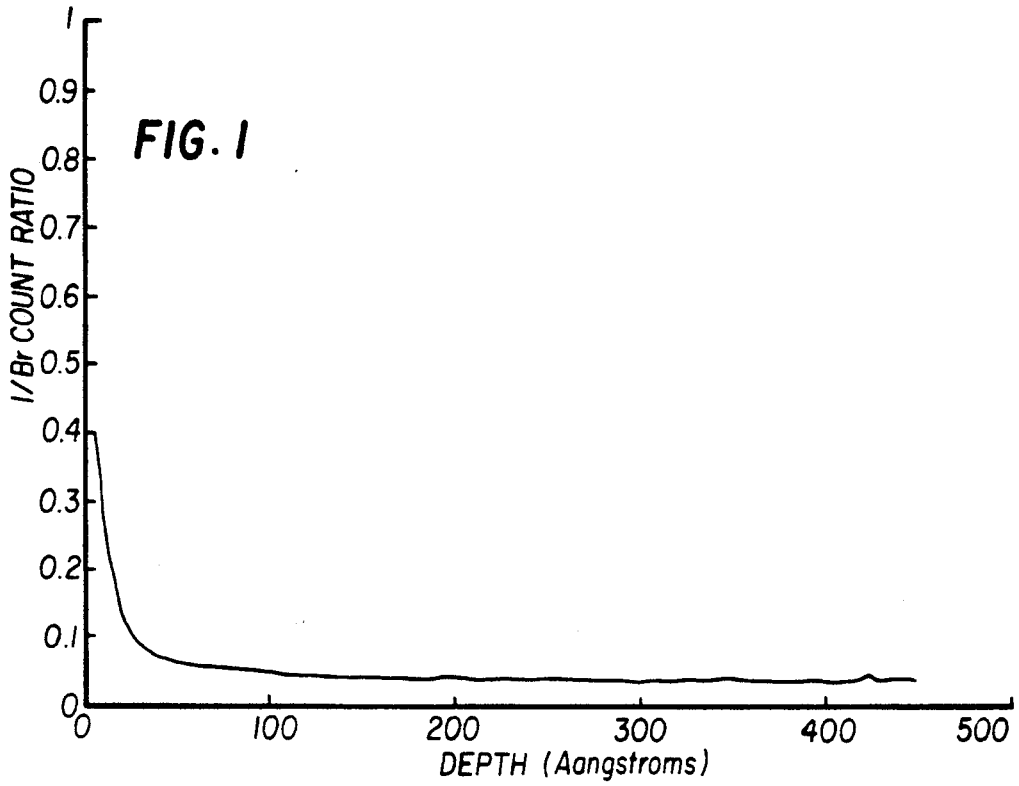
FIGS. 1-11 illustrate the properties of the silver halide grains and emulsions formed in the Examples of the invention.

The invention has numerous advantages over prior practices. Emulsions treated with the chloride salts of the invention prior to coagulation have an improved gamma. By this it is meant that the sensitometric curve is steeper. Further, the sensitometric curves of emulsions formed from grains treated by the invention have a higher Dmax and a lower Dmin than those not treated. This improvement in properties has allowed the improving of already useful emulsions and also the improvement of properties of previous emulsions that do not perform well enough to be useful. It is surprising that the chloride salt treatment serves to remove iodide from grain surface and improve grain properties. The solubility of silver iodide and silver bromide salts would not lead to this as an expected conclusion. Further, it is unexpected that displacement of surface iodide by a chlorine salt would lead to the significant improvement in properties exhibited by the emulsions formed by the invention.

The invention is carried out by addition of a chloride salt to a precipitated emulsion prior to the washing of the emulsion to remove excess salts. Generally the chloride salt is added, such that there is at least a 10-minute hold of the emulsion between addition of the salt and the washing step. Further, it is preferred that the washing be carried out at a higher temperature than is normal, generally at the same temperature as precipitation is carried out.

The chloride salts suitable for the invention may be any salt that provides a suitable improvement in properties of the emulsion treated. The preferred salts are potassium chloride and sodium chloride, as these do not introduce unwanted ions into the precipitation, while resulting in improvement in the silver halide grain and thereby the performance of the emulsion formed containing the grain.

The chloride salt may be added in any effective amount that results in the desired improvement in properties. Typically the salt is added in the amount of 0.05 to about 0.5 moles per liter of material in the kettle. A preferred amount is about 0.2 moles per liter of material. These amounts have been found suitable for normal silver halide solutions densities.

For best performance of the invention, it is preferred that the precipitate be held for a period of at least about 10 minutes after chloride addition in order to complete the treatment of the silver halide grains. Generally the treatment is as short as possible to get the desired effect for the lowest cost and most efficient performance of the invention process. It is within the invention to perform the invention for shorter periods of time if less than the full effect of the chloride treatment is desired or if an excess of chloride is present, such that less treatment time is required.

It is preferred that the addition of chloride and the washing for salt removal be done at the precipitation temperature that in the typical tabular emulsion has a growth stage of between about 60° and 80° C. Typically, salt removal is carried out at a lower temperature, generally between about 30° C. and 50° C. However, for best effect of the invention it has been found that maintaining the precipitation temperature during washing is preferred. It is theorized that the higher than normal washing temperature is preferred as chloride complexes are formed in the precipitation solution. These silver chloride iodide complexes would be more soluble at the higher temperature and less likely to redeposit iodide onto the surface of the grains if washing was performed at higher temperatures.

Washing may be carried out in any desired manner. Typical of methods of washing are ultrafiltration and coagulation. Coagulation is generally preferred and the increased temperature preferred for the invention may be lowered after the first coagulation in washing. Generally several coagulations are carried out in removal of salts from the silver halide grains prior to finishing operations where the grain is sensitized.

The silver halide grains that have been treated in accordance with the invention are unique in that they are bromoiodide grains which have a low iodide content on the surface compared with the iodide content on an equivalent untreated grain. The iodide content on the surface is generally less than about half of the iodide on an equivalent untreated grain. Lesser amounts of surface iodide removal may be suitable in some instances.

After washing, the silver halide grains in gelatin and water may be treated by any of the known sensitizing methods for spectral and chemical sensitization. Such methods are disclosed in the publications discussed in the Background Art. Subsequent to this treatment, the silver halide grains may be utilized in any desired manner including black-and-white, x-ray, color negative, and color transparency films.

The silver bromoiodide grains treated in accordance with the invention may be tabular grains or any other desired crystal structure. Preferred are the tabular grains as they are particularly useful in color negative films.

The following examples are intended to be illustrative and not exhaustive of silver halide grains that may be treated in accordance with the process.

EXAMPLES

Example 1

This emulsion pair 1A and 1B is a 15% iodide banded crystal with the band starting at 80% of the total precipitation and continuing to 95.6% of the total precipitation. The method of iodide incorporation will minimize surface iodide while maintaining a high concentration close to the crystal perimeter below the surface. This type of grain is in less need of the iodide removing technique of the invention than most grains, as the iodide is banded below the surface of the grain.

Emulsion 1A (Control) Tabular Grain AgBrI (2.85 mole % iodide)

To 4.0 liters of a well-stirred 0.125% gelatin solution adjusted to a vAg of 100 mv and a pH of 1.85 at 45° C. were added at a rate of 80 ml/min. for one minute by double-jet, a 0.25 molar silver nitrate solution, and a 0.25 molar sodium bromide solution containing 1.52 mole % potassium iodide (consuming 0.42% of the total silver used). After this addition, 110 grams of a 1.0 molar sodium bromide solution was added, and the temperature increased to 60° C. over 9 minutes. When the temperature reached 60° C., 100 grams of a 0.77 molar solution of ammonium sulfate were added, the pH adjusted to 9.5, and the solution held with continued stirring for 9 minutes. After the 9-minute hold, 500 ml of a 20% gelatin solution was 5 added, the pH adjusted to 5.85. and the vAg adjusted to 1.81 PBr. To the resultant solution were added by double-jet a 5.0 molar silver nitrate solution and a 5.2 molar sodium bromide solution at a flow rate of 4 ml/min. for 45 minutes at a controlled PBr of 1.81 (consuming 76% of the total silver used). The flow rate was reduced to 10 ml/min. and a triple-jet addition of a 5.0 molar silver nitrate solution, a 5.2 molar sodium bromide solution, and 0.1356 moles of a 0.75 molar potassium iodide solution was made to the end of the potassium iodide solution and controlling to 1.81 PBr (consuming 95.6% of the total silver used and forming a 2.98% iodide emulsion). The remaining silver nitrate solution was added as a single-jet addition without PBr control (4.75 moles total silver). The emulsion was cooled to 40° C., washed by the coagulation method of U.S. Pat. No. 2,614,929 of Yutzy and Russell, adjusted to 40 grams per silver mole, and stored. The resultant tabular grain AgBrI (2.85% iodide) emulsion had an average grain diameter of 1.95 micrometers and average thickness of 0.11 micrometers.

Emulsion 1B Tabular Grain AeBrI (2.85% iodide) emulsion given a post precipitation chloride treatment in accordance with the invention This emulsion was made using the procedures of Emulsion 1A up to the addition of 4.75 moles of added silver. When the silver solutions had been added but before cooling the emulsion to 40° C., 500 ml of a 2.94 molar sodium chloride solution was added, and the emulsion held for 10 minutes with continued stirring before coagulating for 15 minutes at 60° C. using the method of U.S. Pat. No. 2,614,929 Example 3. After the 15-minute coagulation, the supernatant was decanted, the temperature reduced to 40° C., and the emulsion washed using the procedures of U.S. Pat. No. 2,614,929. The concentration of gelatin was adjusted to 40 grams per silver mole and the emulsion stored. The resultant tabular grain AgBrI (2.85% iodide) emulsion had an average grain diameter of 1.98 micrometers and an average thickness of 0.105 micrometers.

Measurement of Surface Iodide

Figure 2:
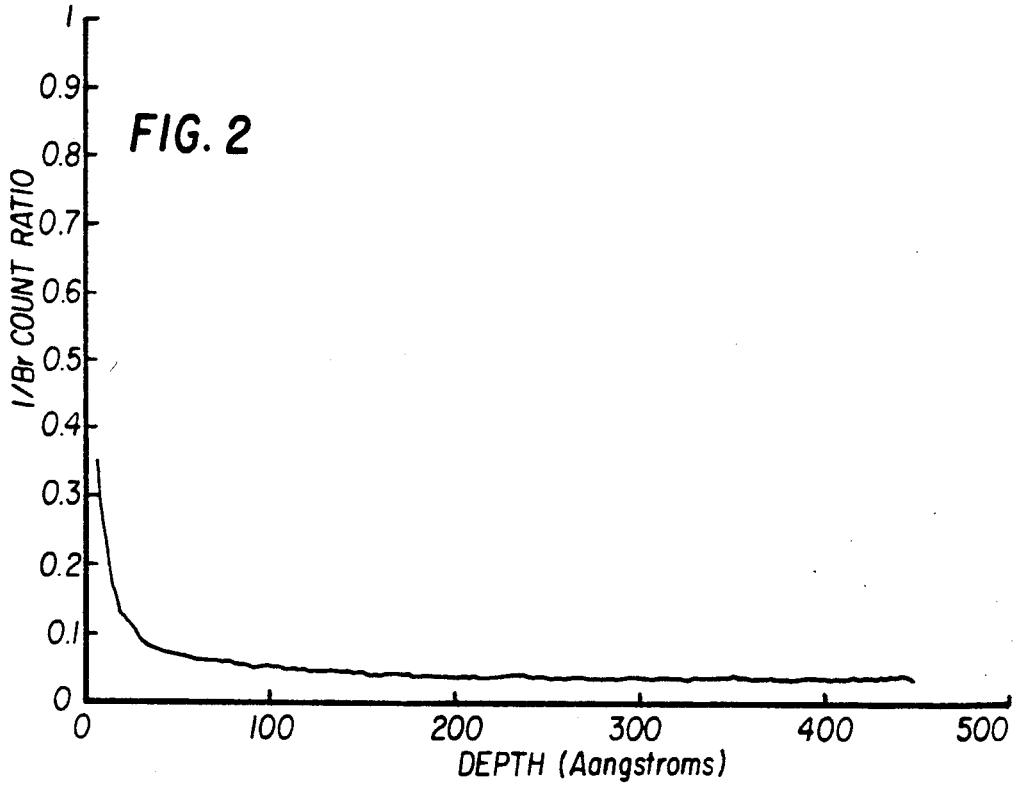

The surface iodide content of the two emulsions (1A and 1B) was determined using the technique of Ion Scattering Spectroscopy (ISS). FIG. 1 shows the relative magnitude of the iodide/bromide ratio as a function of etch depth into the crystal for emulsion 1A, while FIG. 2 shows this data for emulsion 1B. The solid line in FIG. 1 and FIG. 2 is an average of tests on two samples of the emulsion. Comparison of these two figures shows a 12% decrease in the surface iodide level of the chloride treated emulsion (1B).

Photographic Performance

Figure 3:
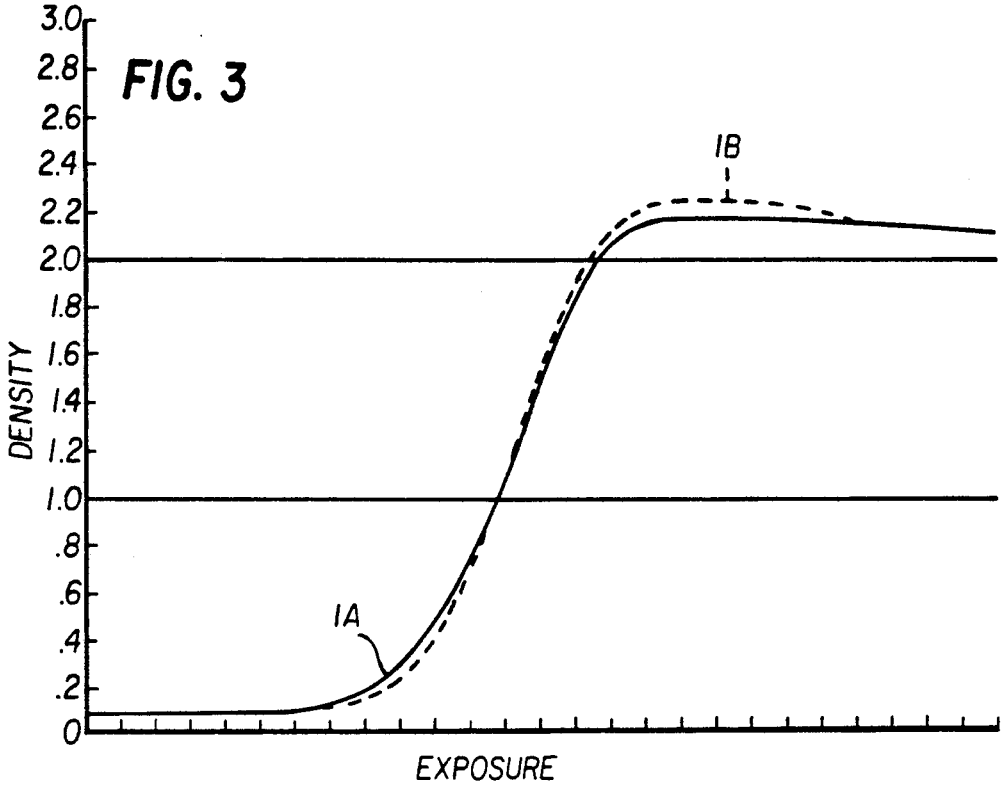

The emulsions were coated on cellulose triacetate film support at 75 mg silver/ft$^2$ and 300 mg gelatin/ft$^2$. The coating also contained a solvent dispersion of the cyan image-forming coupler 76FU at 150 mg/ft$^2$, and the antifoggant 5-methyl-s-triazole-(2-3-a)-pyrimidine-7-ol, sodium salt at 1.0 grams/silver mole. The coatings were overcoated with a 100 mg/ft$^2$ gelatin layer and were hardened at 1.5% with bis(vinylsulfonyl)methane of the total gelatin content. The coatings were exposed for 1 second through a 0–4.0 density step tablet. Processing was for 4 minutes in the standard C-41 color process. Dye density as a function of exposure step for the two emulsions 1A and 1B is shown in FIG. 3. This figure shows the chloride treated emulsion (1B) to have a slightly higher Dmax and contrast than the untreated emulsion (1A). The approvement in the invention 1B emulsion is consistent with the initial low surface iodide in both emulsions. There is a modest decrease in the surface iodide of the chloride treated emulsion (1B).

Example 2

This pair of emulsions, 2A and 2B, were made as structured iodide crystals. The iodide was 4 mole % to 50% of the total precipitation, 41 mole % from 50% to 60% of the total precipitation, and 1% from 60% to 80% of the total precipitation. At 80% of the total precipitation a seed emulsion of AgI equal to 1% of the total precipitated silver was added and the emulsion completed with a 1 mole % addition. The effect of the added AgI seed emulsion is to stop the accelerated lateral growth of the emulsion and produce final growth on all grain surfaces. This procedure places a high iodide concentration on the grain surfaces. The second emulsion of the pair (2B) was given a post precipitation treatment with chloride ion (NaCl at 0.2 M) to remove a portion of the iodide from the grain surface.

Emulsion 2A (Control) Tabular Grain AeBrI (7.5 mole % iodide)

To 4.0 liters of a 0.25% gelatin solution containing 20.6 grams sodium bromide at 50° C. were added with stirring and by double-jet, a 2.5 molar silver nitrate solution and a 2.5 molar sodium bromide solution over a 10-second period (consuming 0.30% of the total silver used). After this first silver addition, the pH of the precipitation solution was increased to 10.0 and the temperature ramped to 70° C. over a 12-minute period. After the 12-minute heat ramp, the solution was held at 70° C. for an additional 5 minutes before adding 4 liters of a 3.5% gelatin solution, reducing the pH to 5.5, and adjusting to PBr of 1.67. The PBr of the solution was maintained at 1.69 PBr to 70% of the total added silver. To this solution were added by triple-jet a 5.2 molar sodium bromide solution containing 1% potassium iodide, 0.21 moles of a 0.15 molar solution of potassium iodide, and a 5.0 molar solution of silver nitrate. These three solutions were added over 44.58 minutes using an accelerated addition rate starting at 0 ml/min. and ramping to 92.2 ml/min. The ramp was divided into 10 linear solution addition segments. The first segment was for one minute and increased the flow rate to 1.79 ml/min. The next eight segments were each 5 minutes long and increased the flow rate in the intervals 1.79 to 3.98 to 7.68 to 13.2 to 21 to 31.1 to 43.7 to 59 and to 77.1. The last segment was for 3.58 minutes and increased the flow rate to 92.2 ml/min. (consuming 50% of the total silver used and forming a 3% iodide emulsion). The iodide solution was consumed, and a second iodide solution containing 0.558 moles of potassium iodide at 2 molar concentration was added by triple-jet addition with the 5.0 molar silver nitrate solution and the 5.2 molar sodium bromide solution containing 1% iodide at a constant flow rate of 92.2 ml/min. for 6 minutes (consuming 60% of the total silver used and forming a 9.1% iodide emulsion). When the second iodide solution was consumed, the addition of the 5.0 molar silver nitrate solution and the 5.2 molar sodium bromide solution containing 1% iodide was continued by double-jet at a constant flow rate of 92.2 mg/min. for 4.5 minutes (consuming 70% of the total silver used and forming a 8.8% iodide emulsion). When 70% of the total silver used had been added, the solution PBr was increased to 3.44, and the flow rate decreased to 25 ml/min. over 4.5 minutes (consuming 80% of the total silver used and forming a 7.6% iodide emulsion). When 80% of the total silver used had been added, the precipitation was stopped and a solution containing 0.14 moles of a silver iodide seed emulsion in 311 grams of solution was added to the precipitation solution. After the addition of the silver iodide seed emulsion, the precipitation was continued by double-jet addition of the 5.0 molar silver nitrate solution and the 5.2 molar sodium bromide solution containing 1% iodide at 25 ml/min. and a controlled PBr of 3.44 until 14.14 moles of silver had been added. The emulsion was cooled to 40° C., washed by the coagulation method of Example 3 of U.S. Pat. No. 2,614,929 of Yutzy and Russell, adjusted to a gelatin concentration of 40 grams per silver mole, and stored. The resultant tabular grain AgBrI (7.5% iodide) emulsion had an average grain diameter of 1.9 micrometers and an average thickness of 0.17 micrometers.

Emulsion 2B Tabular Grain AeBrI (7.5 mole % iodide) emulsion given a post precipitation chloride treatment This emulsion was made using the procedures of Emulsion 2A up to the addition of 14.14 moles of added silver. When the silver solutions had been added but before cooling the emulsion to 40° C., 500 ml of a 5.58 molar sodium bromide solution was added and the emulsion allowed to coagulate for 15 minutes at 70° C. using the method of Example 3 of U.S. Pat. No. 2,614,929. After the 15-minute coagulation, the supernatant was decanted, the temperature reduced to 40° C., and the emulsion washed using the procedures of U.S. Pat. No. 2,614,929. The emulsion was then adjusted to a gelatin concentration of 40 grams per silver mole and stored. The resultant tabular grain AgBrI (7.5% iodide) emulsion had an average grain diameter of 1.9 micrometers and an average thickness of 0.17 micrometers.

Measurement of Surface Iodide

Figure 4:
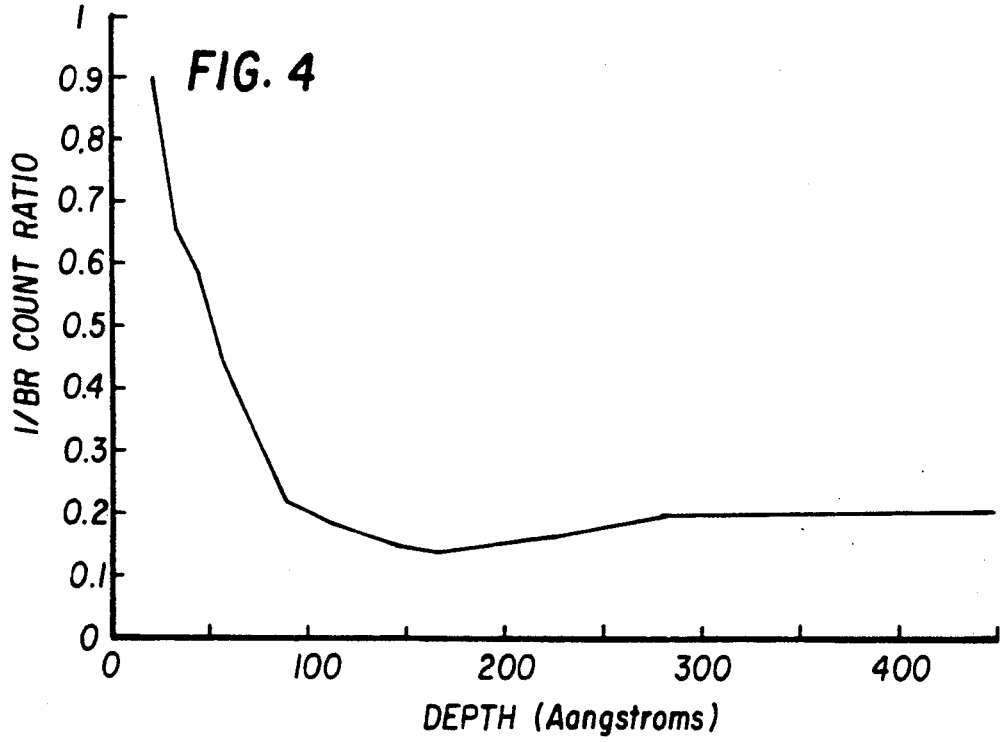
Figure 5:
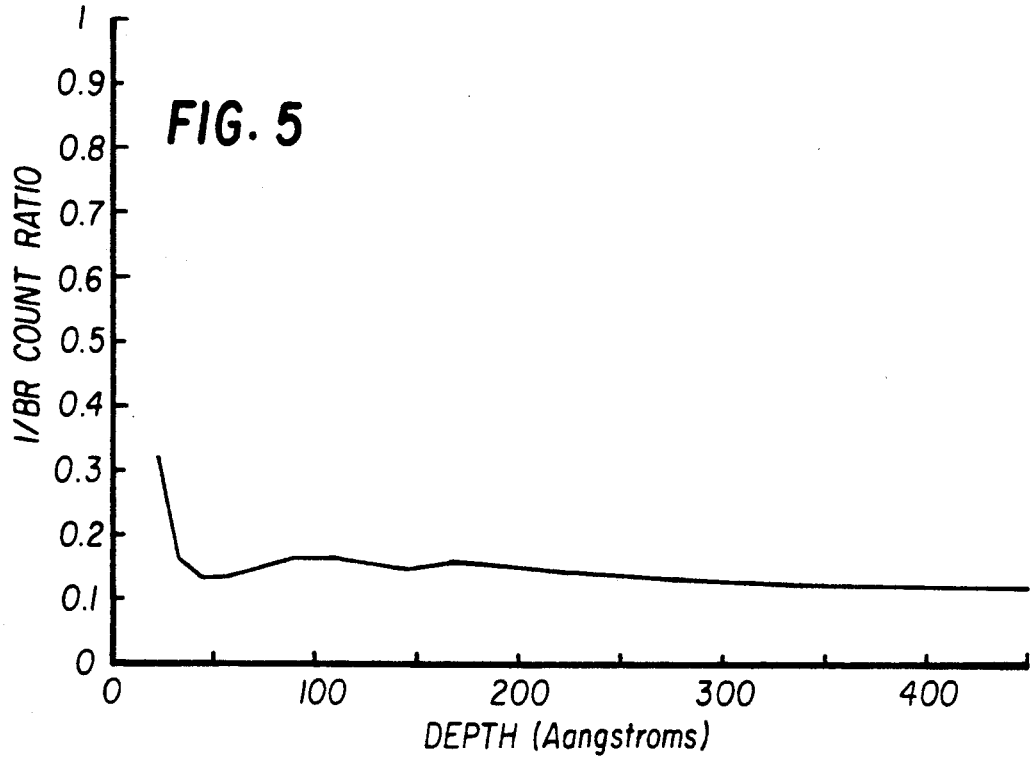
Figure 6:
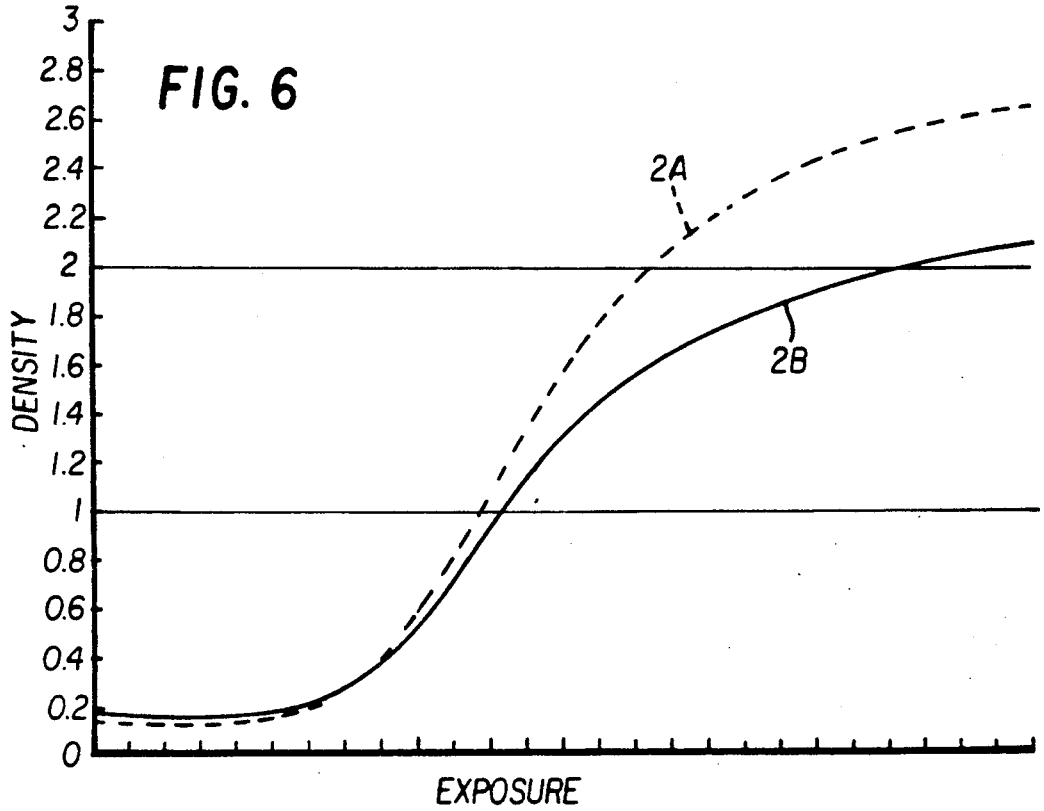

The surface iodide content of the two emulsions (2A and 2B) was determined using the technique of Ion Scattering Spectroscopy (ISS). FIG. 4 shows the relative magnitude of the iodide/bromide ratio as a function of etch depth into the crystal for emulsion 2A, while FIG. 5 shows this data for emulsion 2B. Comparison of these two figures shows a 64% decrease in the surface iodide level of the chloride treated emulsion (2B).

Photographic Performance

The tabular grain emulsions 2A and 2B were chemically and spectrally sensitized with 2.0 mg $Na_2S_2O_3$,5-$H_2O$/silver mole, 1.0 mg $KAuCl_4$/silver mole, 10 mg benzothiazolium boron tetrafluoride/silver mole, 350 mg sodium thiocyanate/silver mole, 0.56 millimole anhydro-5-chloro-9-ethyl-5'-phenyl-3'-(3-sulfobutyl)-3-(3-sulfopropyl) oxacarbocyanine hydroxide, TEA salt/silver mole, and 0.19 millimole anhydro-9-ethyl-3,3'-bis (3-sulfopropyl)-4,5; 4',5'-dibenzooxacarbocyanine hydroxide, sodium salt. The sensitized emulsions were coated on cellulose triacetate film support at 60 mg silver/$ft^2$ and 300 mg gelatin/$ft^2$. The coating also contained a solvent dispersion of the magenta image-forming coupler A at 56 mg/$ft^2$, the antifoggant 5-methyl-s-triazole-(2-3-a)-pyrimidine-7-ol, sodium salt at 1.8 grams/silver mole, and the antistain agent (2-(2-octadexyl)-5-sulfohydroquinone, sodium salt at 1.75 grams/silver mole. The coatings were overcoated with a 100 mg/ft$^2$ gelatin layer and were hardened at 1.75% with bis(vinylsulfonyl)methane of the total gelatin content. The coatings were exposed for 1/100 second through a 0–4.0 density step tablet plus a Wratten No. 9 filter. Processing was for 3 minutes 15 seconds in the standard C-41 color process. Dye density as a function of exposure step for the two emulsions 2A and 2B is shown in FIG. 4. This figure shows the chloride treated emulsion (2A) to have a lower Dmin, higher Dmax and higher contrast than the untreated emulsion (2B).

A

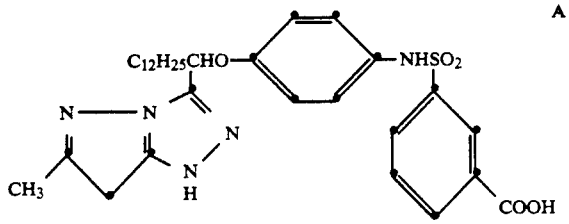

Figure 7:
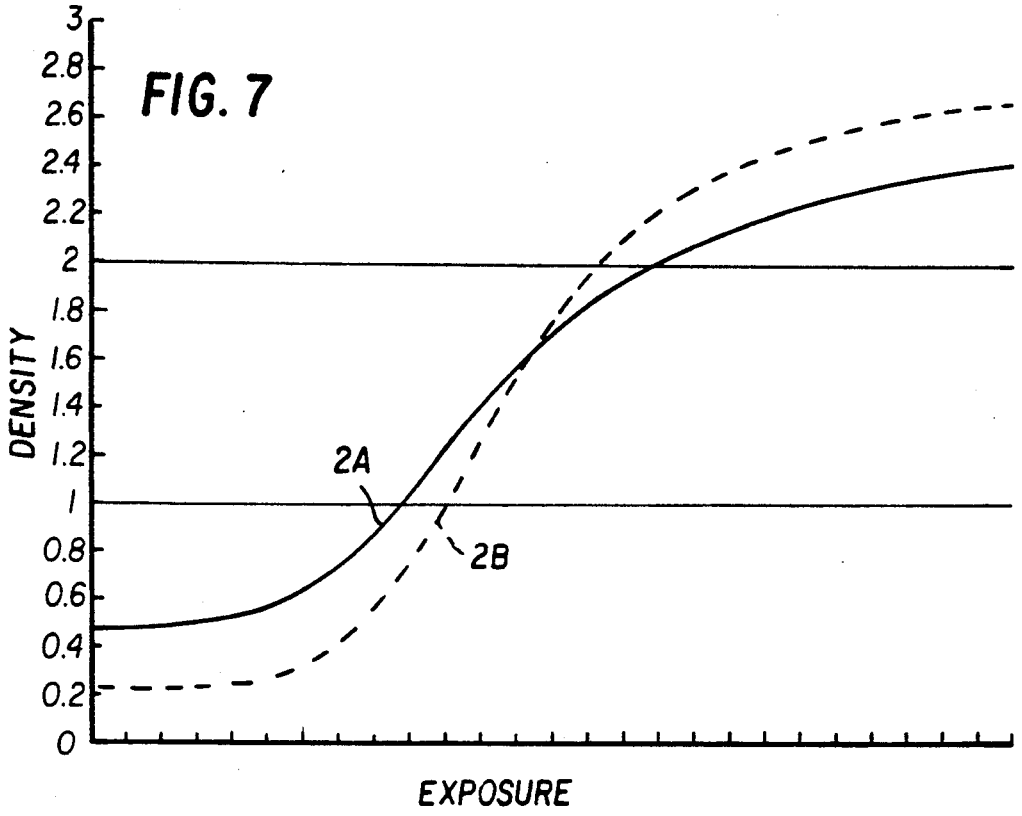

The separate sample of tabular grain emulsions 2A and 2B were chemically and spectrally sensitized with 2.0 mg $Na_2S_2O_3,5H_2O$/silver mole, 1.0 mg $KAuCl_4$/silver mole, 10 mg benzothiazolium boron tetrafluoride/-silver mole, 300 mg sodium thiocyanate/silver mole, 0.525 millimole anhydro-5-chloro-9-ethyl-5'-phenyl-3'-(3-sulfobutyl)-3-(3-sulfo propyl) oxacarbocyanine hydroxide, TEA salt/silver mole, and 0.175 millimole anhydro-9-ethyl-3,3'-bis (3-sulfopropyl)-4,5; 4',5'-dibenzooxacarbocyanine hydroxide, sodium salt. These emulsions were coated, exposed, and processed as described above. Dye density as a function of exposure step for the new sensitization of the two emulsions are shown in FIG. 7. This figure shows the chloride treated emulsion (2A) to have a lower Dmin, higher Dmax and higher contrast than the untreated emulsion (2B).

Figure 8:
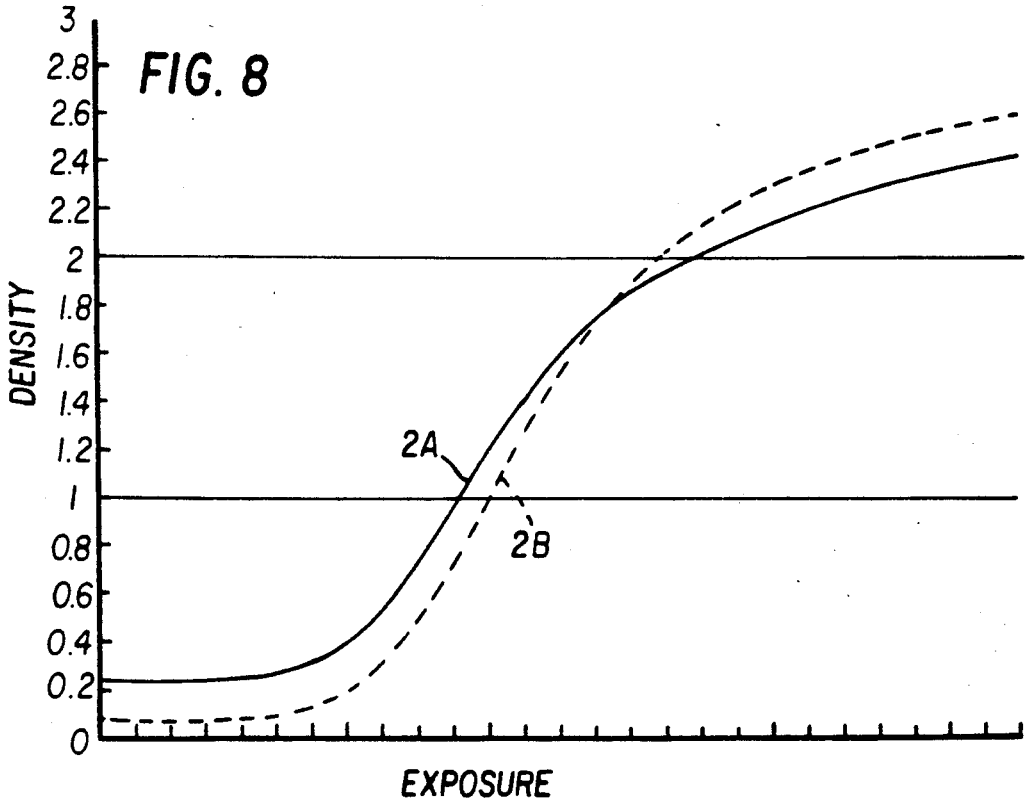

The tabular grain emulsions 2A and 2B were chemically and spectrally sensitized a third time with 1.75 mg $Na_2S_2O_3,5H_2O$/silver mole, 0.78 mg $KAuCl_4$/silver mole, 5 mg benzothiazolium boron tetrafluoride/silver mole, 350 mg sodium thio- cyanate/silver mole, 0.525 millimole anhydro-5-chloro-9-ethyl-5'-phenyl-3'-(3-sulfobutyl)-3-(3-sulfopropyl) oxacarbocyanine hydroxide, TEA salt/silver mole, and 0.175 millimole anhydro-9-ethyl-3,3'-bis (3-sulfopropyl)-4,5; 4',5'-dibenzooxacarbocyanine hydroxide, sodium salt. These emulsions were coated, exposed, and processed as described above. Dye density as a function of exposure step for the third sensitization of the two emulsions are shown in FIG. 8. This figure shows the chloride treated emulsion (2A) to have a lower Dmin, higher Dmax and higher contrast than the untreated emulsion (2B).

Comparative Example 3

This pair of emulsions 3A and 3B were made using procedures designed to produce a high surface iodide concentration in a 2.67 mole % iodide emulsion.

Emulsion 3A Tabular Grain AgBrI (2.67 mole % iodide)

To 4.0 liters of a well-stirred 0.125% gelatin solution adjusted to a vAg of 100 mv and a pH of 1.85 at 45° C. were added at a rate of 80 ml/min. for one minute by double-jet, a 0.25 molar silver nitrate solution, and a 0.25 molar sodium bromide solution containing 1.52 mole % potassium iodide (consuming 0.44% of the total silver used). After this addition, 110 grams of a 1.0 molar sodium bromide solution was added, and the temperature increased to 60° C. over 9 minutes. When the temperature reached 60° C., 100 grams of a 0.77 molar solution of ammonium sulfate were added, the pH adjusted to 9.5, and the solution held for 9 minutes. After the 9-minute hold, 500 ml of a 20% gelatin solution was added, the pH adjusted to 5.85. and the vAg adjusted to 4 mv. To the resultant solution were added by double-jet a 5.0 molar silver nitrate solution and a 5.2 molar sodium bromide solution at a flow rate of 4 ml/min. for 45 minutes at a controlled vAg of 4 mv (consuming 19.3% of the total silver used). The double-jet addition was continued for an additional 28.6 minutes using an accelerated flow rate starting at 4 ml/min. and ramping to 27.4 ml/min. controlling the vAg at 4 mv (consuming 70.5% of the total silver used. The flow rate of the double-jet addition was then reduced from 27.4 ml/min. to 10 ml/min. and the vAg increased to 125 mg (PBr to 3.64) over the next 4.8-minute period (consuming 80% of the total silver used). The precipitation was then stopped and 187 grams of a solution containing 0.12 moles of a silver iodide seed emulsion was added. After the addition of the silver iodide seed emulsion, the precipitation was continued by adding by double-jet the remainder of the 4.5 moles of silver contained in the 5.0 molar silver nitrate solution and enough of the 5.2 molar sodium bromide solution to control the PBr 3.64. The emulsion was cooled to 40° C., washed by the coagulation method of U.S. Pat. No. 2,614,929 of Yutzy and Russell, adjusted to a gelatin concentration of 40 grams per silver mole, and stored. The resultant tabular grain AgBrI (2.67% iodide) emulsion had an average grain diameter of 1.84 micrometers and average thickness of 0.11 micrometers.

Emulsion 3B Tabular Grain AgBrI (2.67% iodide) emulsion given a post precipitation chloride treatment This emulsion was made using the procedures of Emulsion 3A up to the addition of 4.52 moles of added silver. When the silver solutions had been added, the temperature was increased to 70° C., 500 ml of a 2.94 molar sodium chloride solution was added, and the emulsion held for 15 minutes before coagulating for 15 minutes at 70° C. using the method of U.S. Pat. No. 2,614,929. After the 15-minute coagulation, the supernatant was decanted, the temperature reduced to 40° C., and the emulsion washed using the procedures of Example 3 of U.S. Pat. No. 2,614,929. The emulsion was adjusted to 40 grams per silver mole and stored. The emulsion was adjusted to a gelatin concentration of 40 grams per silver mole and stored. The resultant tabular grain AgBrI (2.67% iodide) emulsion had an average grain diameter of 1.88 micrometers and an average thickness of 0.11 micrometers.

Measurement of Surface Iodide

Figure 9:
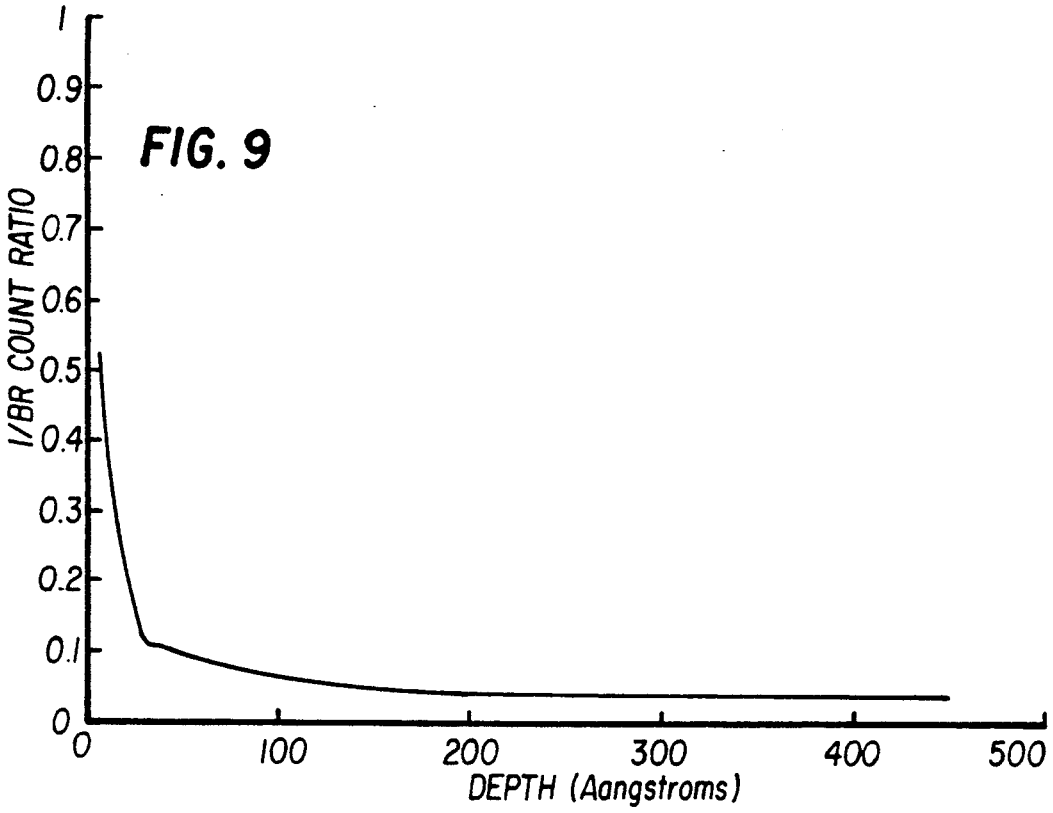
Figure 10:
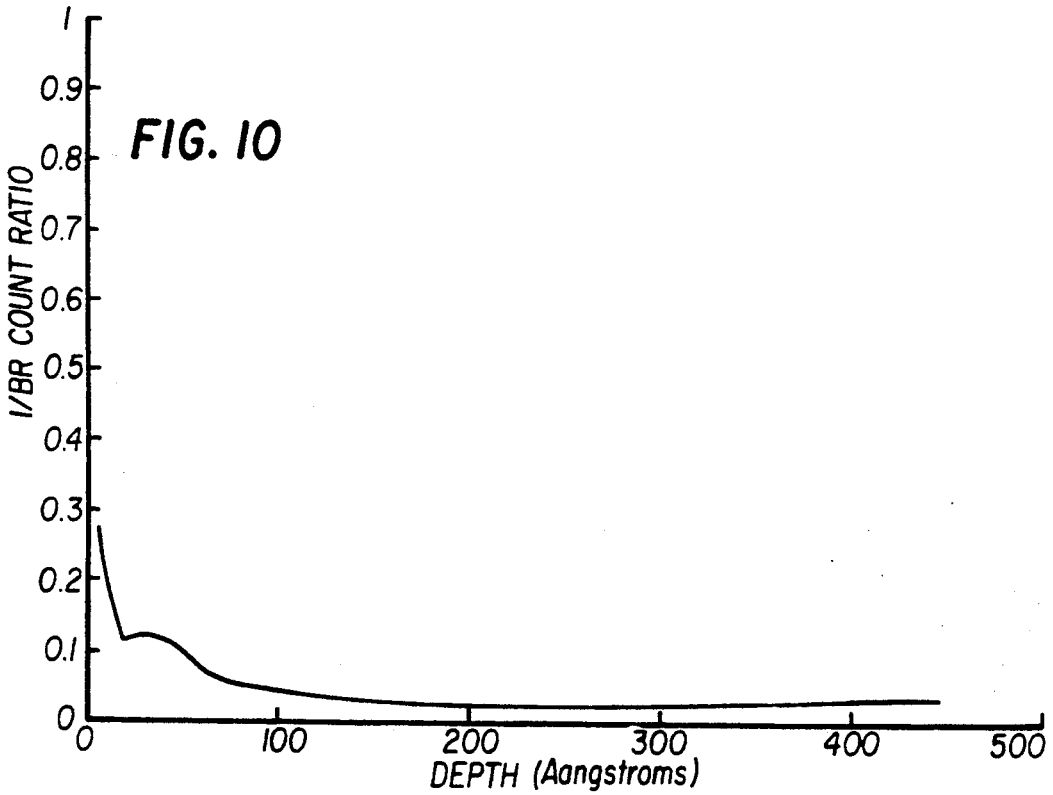

The surface iodide content of the two emulsions (3A and 3B) was determined using the technique of Ion Scattering Spectroscopy (ISS). FIG. 9 shows the relative magnitude of the iodide/bromide ratio as a function of etch depth into the crystal for emulsion 3A, while FIG. 10 shows this data for emulsion 3B. Comparison of these two figures shows about a 48% decrease in the surface iodide level of the chloride treated emulsion (3B).

Photographic Performance

The emulsions were coated on cellulose triacetate film support at 75 mg silver/ft$^2$ and 300 mg gelatin/ft$^2$.

Figure 11:
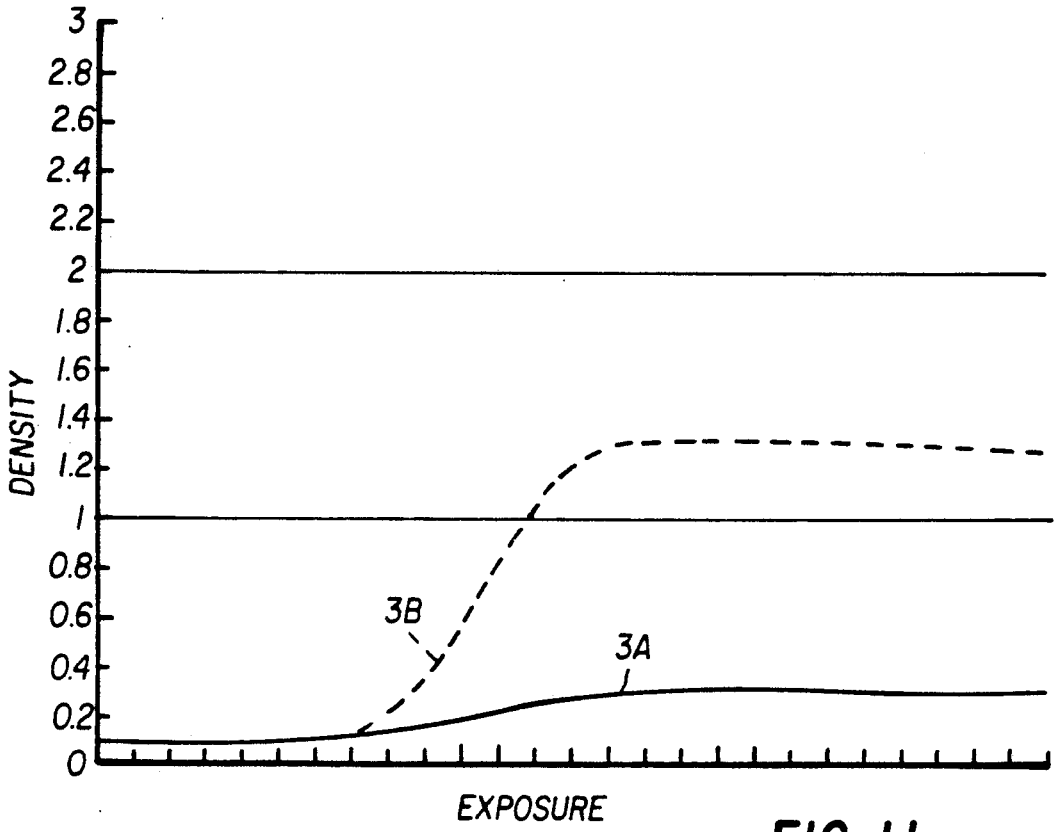

The coating also contained a solvent dispersion of the cyan image-forming coupler B at 150 mg/ft$^2$, and the antifoggant 5-methyl-s-triazole-(2-3-a)-pyrimidine-7-ol, sodium salt at 1.8 grams/silver mole. The coatings were overcoated with a 100 mg/ft$^2$gelatin layer and were hardened at 1.5% with bis(vinylsulfonyl)methane of the total gelatin content. The coatings were exposed for 1 second through a 0–4.0 density step tablet. Processing was for 4 minutes in the standard C-41 color process. Dye density as a function of exposure step for the two emulsions 3A and 3B is shown in FIG. 11. This figure shows the chloride treated emulsion (3B) to have a much higher Dmax and contrast than the untreated emulsion (3A). These changes are consistent with the large decrease in the surface iodide produced by the chloride treatment in emulsion 3B.

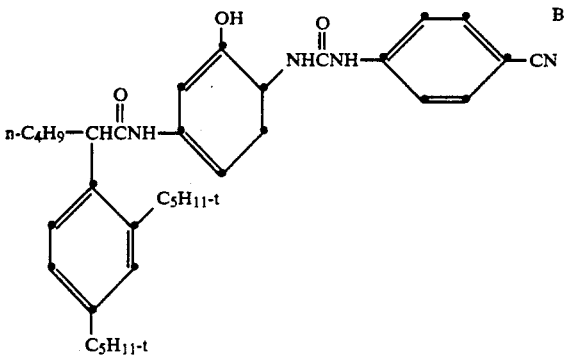

The above illustrations of the invention clearly show that the treatment with chloride ion after precipitation leads to improved performance in grains that have iodide on the surface of the grain. The improvement in performance appears to be dependent upon the amount of iodide initially present for removal by the process. Significant improvements in photographic performance are clearly shown by those grains in which enough iodide is on the surface, such that about half is removed by the invention.

The invention has been described in detail with particular reference to preferred embodiments thereof, but it will be understood that variations and modifications can be effected within the spirit and scope of the invention.

I claim:

1. A method of forming improved silver bromoiodide tabular grains comprising preparing a precipitation of said silver bromoiodide tabular grains and adding a chloride salt to said precipitation and, washing said precipitation to remove salt by products of grain formation prior to sensitization of said grains.

2. The method of claim 1 wherein said chloride salt comprises potassium chloride or sodium chloride.

3. The method of claim 1 wherein said chloride salt is added in an amount of between 0.005 and 0.5 moles per liter of said precipitation.

4. The method of claim 3 wherein about 0.2 moles/-liter of said salt are added.

5. The method of claim 1 wherein said grains comprise between about 0.5 and about 12 percent iodide.

6. The method of claim 5 wherein said grains comprise between about 1% and about 6% iodide.

7. The method of claim 1 wherein there is a holding period of at least about 10 minutes between said chloride salt addition and said washing.

8. The method of claim 1 wherein said salt is added at about the temperature at which precipitation was carried out.

9. The method of claim 7 wherein precipitation, salt addition, holding period and said washing are carried out at about the same temperature.

10. The method of claim 1 wherein the surface of said grains has less than one half the surface iodide of an untreated grain.

* * * * *